United States Patent [19]

Elliott

[11] Patent Number: 4,524,492

[45] Date of Patent: Jun. 25, 1985

[54] CARDING APPARATUS AND METHOD

[76] Inventor: Olin S. Elliott, P.O. Box 8675, Greenville, S.C. 29604

[21] Appl. No.: 452,745

[22] Filed: Dec. 23, 1982

[51] Int. Cl.[3] ..... D01G 15/42; D01G 15/76

[52] U.S. Cl. ..... 19/107; 19/95; 19/105

[58] Field of Search ..... 19/105, 106 R, 107, 19/98, 99, 95

[56] References Cited

U.S. PATENT DOCUMENTS

| | | | |
|---|---|---|---|
| 2,619,682 | 12/1952 | Varga | 19/991 |
| 3,955,244 | 5/1976 | Jenkins | 19/107 |
| 3,983,273 | 9/1976 | Elliott | 19/99 X |
| 4,126,914 | 11/1978 | Winch et al. | 19/99 |
| 4,157,601 | 6/1979 | Elliott | 19/95 |
| 4,241,475 | 12/1980 | Miller | 19/107 X |
| 4,274,177 | 6/1981 | Grimshaw et al. | 19/99 |
| 4,309,796 | 1/1982 | Garrison et al. | 19/98 |
| 4,366,601 | 1/1983 | Beneke | 19/95 X |

*Primary Examiner*—Louis K. Rimrodt

*Attorney, Agent, or Firm*—Bailey & Hardaway

[57] ABSTRACT

Carding apparatus and method is disclosed wherein a plurality of lickerin rolls are provided for use with a combination card screen and plenum providing trash removal points so spaced as to provide, together with multiple carding locations, more even carding with less broken fibers and improved trash removal.

9 Claims, 3 Drawing Figures

CARDING APPARATUS AND METHOD

BACKGROUND OF THE INVENTION

Various cleaning apparatuses are used in carding, including fiber retrievers such as illustrated in U.S. Pat. No. 3,955,244, for removing dust, trash and short fibers in the area of the lickerin. The use of multiple carding rolls is illustrated in U.S. Pat. No. 4,126,914, wherein a number of rolls are provided for incrementally drafting the carded web. A front screen of the general type illustrated herein is disclosed in U.S. Pat. No. 4,157,601.

SUMMARY OF THE INVENTION

It has been found that improved carding can be achieved by utilizing multiple lickerin rolls together with a main cylinder screen interposed on the main cylinder, preceding transfer of the web thereto and, following doffing, in combination with a suction plenum for removing air at multiple points along the cylinder. Thus the carding points where trash may be removed have been multiplied and spread out resulting in a gentler action upon the fibers with less broken fibers and improved cleaning.

The main carding cylinder is more efficient when it does not have to deal with as much trash and short fiber.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
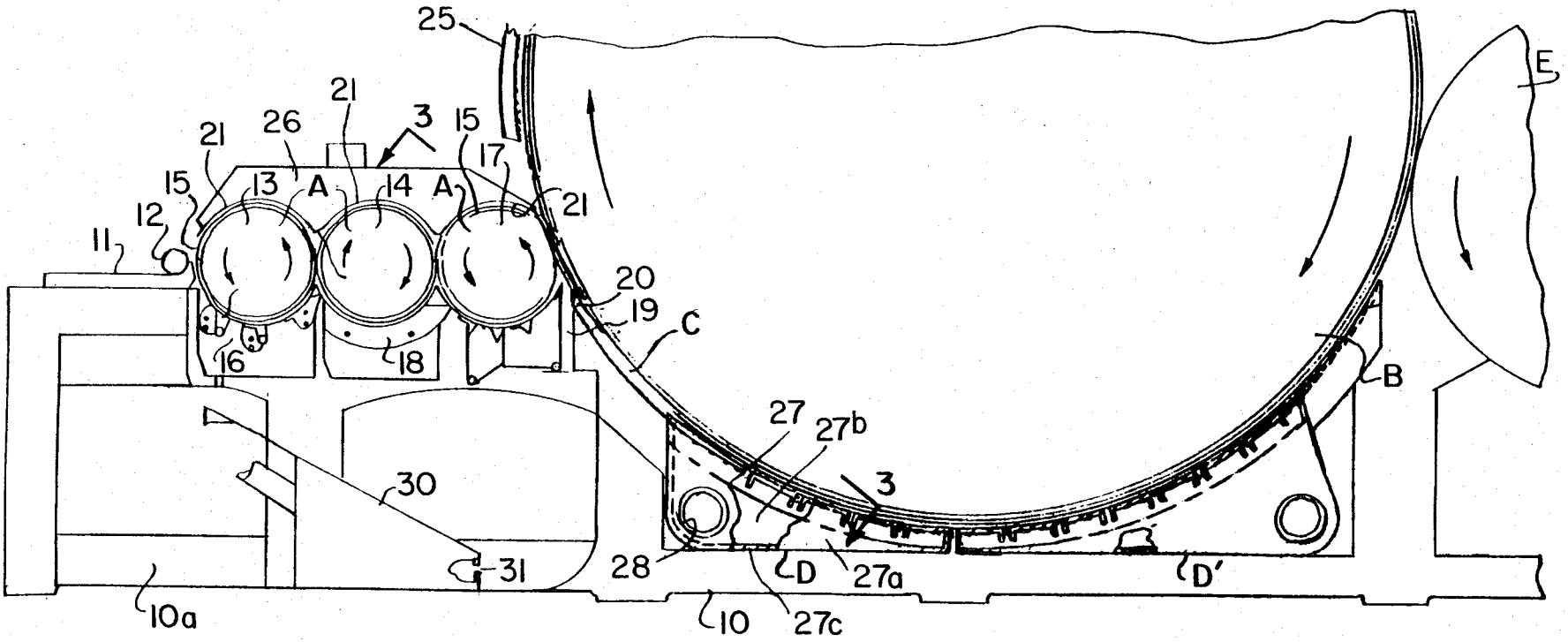
FIG. 1 is a schematic side elevation illustrating a carding apparatus constructed in accordance with the present invention.
Figure 2:
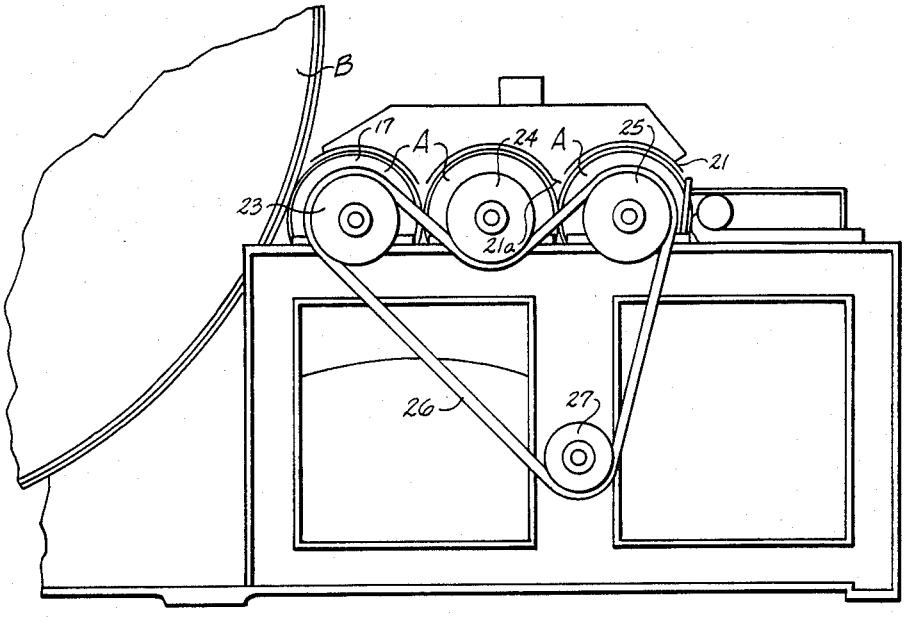
FIG. 2 is a schematic side elevation looking toward a side of the card opposite that of FIG. 1 illustrating the driving mechanism for the lickerin rolls.
Figure 3:
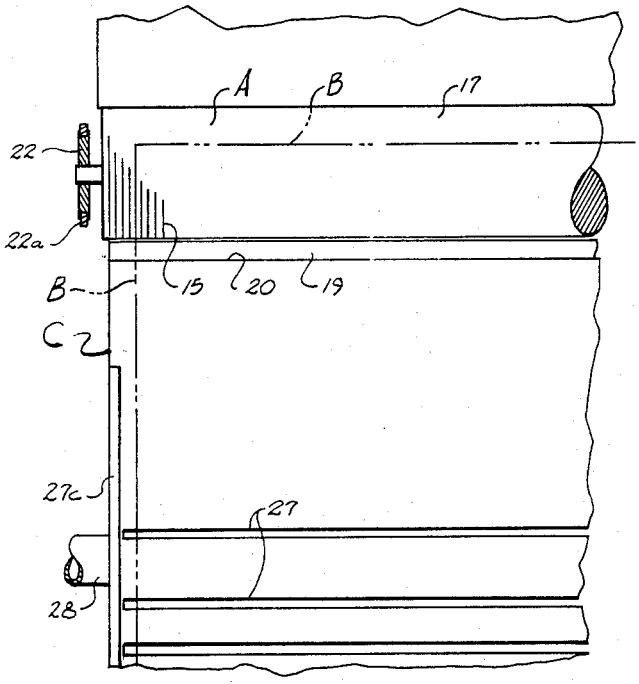
FIG. 3 is a schematic sectional view taken on the line 3—3 in FIG. 1 with parts omitted.

The drawings illustrate a carding machine having a plurality of lickerin rolls A and a cylinder B receiving opened fibers from the lickerin rolls. The improvement includes a card screen C extending partially about the cylinder. The card screen has a plurality of circumferentially spaced transverse slots thereacross for relieving air currents generated by the action of the cylinder during carding. An air suction plenum D extends substantially across the card screen and circumferentially thereof, following the doffer roll E and preceding the lickerin rolls A for relieving pressure within the screen generated by the air currents.

Carding machines presently in service include a stationary feed plate, a rotating feed roll, a lickerin roll, a cylinder which has superposed revolving flats or stationary carding plates, and a doffer followed by a take-off mechanism.

The material to be carded is fed between the feed plate and feed roll where it is tightly held and presented to the lickerin roll so that the teeth of the lickerin roll can comb the leading edge of the material being fed.

The teeth of the lickerin are angled so that as they comb through the material being fed, they will pick up a deposit of the material. The lickerin roll is rotating in such a manner that it carries the material downward past the nose of the feed plate and under the bottom of the lickerin roll to where it is transferred to the cylinder. The direction of the lickerin rotation is counter-clockwise as illustrated by the arrows in the drawings.

As the lickerin roll rotates it passes the material over cleaning devices and openings which are designed to remove as much as possible of the undesirable components of the fed material; such as, trash, dirt, short fibers, or any other material which in either natural or man-made fiber will deteriorate the quality of the yarn if not removed.

The lickerin and its screens are considered the primary cleaning devices of the card even though the stock being processed is on the lickerin for approximately one-half a revolution and makes one pass over the lickerin screens before being transferred to the cylinder.

The cylinder, rotating in a clockwise direction because of its larger size, greater surface speed and the shape of its teeth, takes the material from the lickerin and causes it to be passed under either revolving flats or stationary carding plates and around to the doffer roll where some of the material is transferred to the doffer but some also continues beyond the doffer for several more revolutions of the cylinder. Eventually, the rate of material transferred from the lickerin to the cylinder and from the cylinder to the doffer must become equal, although some fiber stock is retained on the cylinder for several revolutions of the cylinder before being transferred to the doffer, although some is transferred on the first revolution. The material that is not transferred to the doffer is carried over the front and back cylinder screens and by the lickerin where additional incoming material, transferring from the lickerin, is deposited over and beside the material already on the cylinder.

Cleaning of the material while it is on the cylinder takes place by the action of the flats or carding plates. The flats remove, by direct action, short fibers and small particles in the form of "toppings" or "flat strips," and on some of the stationary carding plates removal is facilitated by air suction between the plates such as illustrated in U.S. Pat. No. 4,309,796.

The front and back cylinder screens are a combination of blanked and open spaces that are used to control the air currents created by the cylinder and to allow additional short fiber and dust to be dusted out of the material that has not been transferred to the doffer.

The card as a single machine does remove a tremendous amount of the undesirable material from the stock being processed, and as a double or tandem unit where the material is fed directly to a second carding machine, the quality and cleanliness of the yarn produced is even better, and less floor space is required with reduced power requirements; however, much foreign material still remains to deteriorate the quality of the yarn. Tandem carding often results in overcarding with broken fibers. The present system causes an increase in the quality of the yarn by increasing and improving the carding process, which is the opening and combing of the fiber, and particularly by removing more of the undesirable material prior to cylinder action.

The desirable criteria for the quality of the yarn produced hereby are: absence of trash particles, absence of neps (small tangles of fiber), absences of short of unspinable fibers, improved breaking strength, improved parallelization of fibers, and the overall evenness called the coefficient of variation. The present system addresses each of these and improves the performance of the carding machine at each point.

The conventional card has one roll, the lickerin and its screens between the feed plate, feed roll and the cylinder which has a cleaning area of approximately $\frac{1}{3}$ of the surface area of the roll, and the stock passes over the screens only one time.

The present system introduces two additional rolls, and sometimes three, with specially designed screens between the feed plate, feed roll and cylinder. This more than doubles the available cleaning area between the feed plate and cylinder, increases the cleaning and creates additional carding before the cylinder. A more detailed description and explanation follows.

An extension of the side frame members 10 of the card is provided at 10*a* for the relocation of the feed plate 11 and feed roll 12 so that the additional rolls are mounted on the original frame members.

The first or primary lickerin 13 is mounted on the card frame adjacent to the feed plate in independently adjustable ball bearing housings (not shown) which allows it to be adjusted and set to the second or transfer roll 14.

The roll 13 is preferrably clothed with groove wound, metallic lickerin wire 15 of a type commonly supplied by several manufacturers, as are the other lickerin rolls illustrated. This roll is rotated in the counter-clockwise direction the same as the conventional single lickerin. The bearing housings have attached to them screens 16 which extend below the running surface of the lickerin, and this may be of the type illustrated in, of common assignee, U.S. patent application Ser. No. 181,772, filed Aug. 27, 1980 now U.S. Pat. No. 4,472,859 granted Sept. 25, 1984 to Elliott et al., the disclosure of which is incorporated herein by reference. These screens have bars 16*a* which are independently adjustable as to their relationship to each other and to the primary lickerin roll. Presently in use are two of these waste control screen bars on the primary lickerin. These are fixed to side plates which are in turn fixed to the bearing housing which causes them to keep their relationship to the primary lickerin should it be adjusted to the transfer roll. The final screen section on the primary lickerin is designed and set so that the air currents on the primary lickerin are allowed to blossom away from the roll before reaching its closest point to the transfer roll. This causes the fiber to move to the outer surface of the roll to facilitate the transfer.

The primary lickerin 13 is driven at a fixed speed by means of a suitable driving arrangement. The speed of rotation is determined according to variable factors such as type of stock and production rate and is set such as to allow for maximum cleaning and opening of heavy trash or fiber clumps at this point without damaging good fibers by too harsh an action at the nose of the feed plate. This is a major advantage because on the single lickerin, in order to try and remove fine trash and dust in the limited space and time available when increased lickerin speeds are used, increased fiber damage and broken fiber results.

The second lickerin roll 14 is also mounted in adjustable bearing housing (not shown) and is in effect a transfer roll. Its function is to take the fiber from the primary lickerin and transport it to the secondary lickerin 17.

As with the primary lickerin, screens 18 are affixed to the bearing housings so as to mount the screen section under the transfer roll so that it adjusts with the transfer roll as required.

The transfer roll is clothed with groove wound wire similar in shape to that used on the primary roll and is turning in a clockwise direction. The speed of the transfer roll is approximately 10% or more faster than that of the primary lickerin and is fixed in its relationship. As the transfer roll takes the fiber from the primary lickerin, an opening and carding action takes place because of the fiber being pulled from the teeth of the primary roll by the teeth of the transfer roll with its greater surface speed. A drafting action is also produced by this exchange as the progress of the fiber accelerates. This increases the parallelization of the fiber-to-fiber relationship and loosens and separates trash particles, short fiber and dust remaining in the material at this point in the process.

The third roll or secondary lickerin 17 is between the transfer roll and cylinder. It is mounted in the existing lickerin bearing mountings and is set to the cylinder as is the original single lickerin. The speed is at least 10% greater than the transfer roll but may be increased, without fiber damage, if needed for additional cleaning action. The secondary lickerin is clothed preferably with a groove wound wire similar to that used on the primary and transfer rolls.

The surface speed of the secondary lickerin, is at least 10% faster than that of the transfer roll, creating a drafting action to comb the fiber and loosen the trash, dust and short fiber as transfer takes place.

The screen section under the transfer roll is formed so that it presents an area to the third roll of the system (secondary lickerin) which stimulates the cleaning process. The vortex created, which increases the velocity of the air currents, explodes or bursts out of the restriction created to expel from the lickerin surface the trash and dust which has been loosened by the drafting/carding action. This is followed by an open space 19 to allow the air and centrifugal force to expel the loose trash, dust and short fiber. The open space is followed by a special screen C incorporating a metal edge 20 over which the fiber is drawn by the secondary lickerin causing a whipping action to dislodge trash, short fiber and dust from the fiber.

The upper surfaces of the individual rolls are covered by curved metal covers 21, each roll being individually covered with a space left between each of the covers to allow for air relief. The cover over the transfer roll at is conjunction with the primary roll is canted away from the radius of the transfer roll as at 21*a* to capture the air from the primary roll to assist in the transfer.

Over the covers of the individual rolls, a secondary cover or vacuum plenum 26 is used from which a vacuum is pulled to remove excess air from the three rolls so that loss of good fiber will not be created by too strong an air current under the lickerin rolls.

The secondary lickerin 17 is driven by a flat belt 22*a* and pully 22 from a pully (not shown) on the cylinder in the manner of a conventional single lickerin roll. Single V-groove pulleys 23, 24 and 25 are mounted on the extended shafts of the secondary, transfer and primary rolls, and the transfer roll by going under the transfer roll pulley 24 and then to the primary roll by going around the outside of the primary roll pulley 25. The belt tightness may be maintained by means of an adjustable idler 27. These pulleys may be varied to change speed relationships as long as the basic incremental increases are maintained.

OPERATION

The primary lickerin 13 takes the fed material consisting of good fiber, trash, short fiber, neps and immature fiber from the feed roll feed plate and subjects it, as it rotates over the cleaning members, to the initial drafting, opening and cleaning at a surface speed consistent with good cleaning, but not at an excessive surface speed which will cause fiber damage. This primary cleaning removes the larger and heavier particles of undesired material. The transfer roll 14 takes the material from the primary roll accelerating its speed at the same time creating additional drafting and carding and preparing the material for the secondary roll.

The secondary roll 17 receives the material in its opened state and does additional opening and drafting at the same time. The trash, short fiber, neps and other objectionable material have been loosened from the good fiber at this point and can be removed by the screens to a greater degree than heretofore possible. This results in a much cleaner fiber being deposited on the cylinder B than with any single lickerin system allowing the cylinder clothing and revolving flats or stationary carding plates to be more efficient in their operation. Stationary flats such as described in U.S. Pat. Nos. 3,604,062 and 3,604,475 are illustrated at 25.

The next stage of the improved carding system involves the undercard screens. In this respect the system further departs from the original concept of the screens under the cylinder being passive as far as cleaning is concerned, and creates a screen that takes an active part in the cleaning process.

The number of openings in these cylinder screens is reduced, and, in combination as a part of the screen system, a plenum is constructed which removes air, short fiber and dust from the cylinder by suction.

As stated previously, not all of the fiber mass transfers to the doffer on its initial pass of the doffer; most of it is known to take several revolutions to transfer. Thus, longer fiber will transfer to the doffer more easily than short fiber; therefore, the fiber left on the cylinder past the doffer has a higher percentage of short fiber in its mass. Dust also does not readily transfer. This is evident by the nature of the waste that normally accumulates on the floor under the cylinder screens. The waste is always very short dirty fiber and dust. Suction, through controlled spaced openings 27 in the cylinder screens D and D′, removes more of the short fiber and dust than will voluntarily come out through the existing screen openings resulting in a cleaner fiber mass with a longer average fiber length on the cylinder. The screen plenum has sides *27a* and *27b* as well as a bottom *27c*. A suction opening is provided at 28.

One of the openings in the screen is under the tangent point of the secondary lickerin and cylinder which is usually solid and formed into what is called the nose section of the back screen, with the two sides curved to fit the lickerin roll and cylinder respectively. The opening 20 left in this area is preferably 1″ wide and extending across the width of the card called the special unit cleaning chamber. This allows foreign matter, particularly short fiber and dust, to be removed from the processed fiber at its point of transfer to the cylinder from the lickerin.

A cleaner cylinder is produced with reduced amounts of short fiber and dust that the cylinder must handle, which causes the cylinder to better clean the desirable fiber. Thus the under-cylinder area of the card is kept clean as part of the undercard cleaning system. The dust level at the card and in subsequent processes will also be reduced by the direct removal of this waste from the cylinder.

Since a larger percentage of the foreign matter is removed by multiple cleaning rolls on the card, it is desirable to re-design the cleaning plenums under the rear of the card. The existing plenums normally used rely on suction from a closed area with occasional bursts of air from air jets to move the fiber to the plenum. In the present system a partial vacuum is created under the card when the jets are not active. Once the vacuum is created, there is no flow of moving air carrying the waste to the pickup point, and at the pickup the plenum is starved for air allowing an accumulation of material which can choke the plenum when blown suddenly to the plenum.

An under-lickerin plenum with air access from the rear of the machine is illustrated showing that a continuous flow of moving air is sweeping across the forwardly, downwardly inclined top 30 of the plenum and down into the pickup point 31. This keeps the material which is expelled from the lickerin moving continuously and does not require bursts of compressed air which can blow the waste materials back into the work flow of the card to cause a deterioration of carding quality.

While a preferred embodiment of the invention has been described using specific terms, such description is for illustrative purposes only and it is to be understood that changes and variations may be made without departing from the spirit or scope of the following claims.

What is claimed is:

1. In a carding machine having a plurality of lickerin rolls and a cylinder receiving opened fibers from said lickerin rolls, the improvement including:

a card screen extending partially about said cylinder;

said card screen having spaced sides and a bottom defining a plurality of circumferentially spaced transverse slots thereacross for relieving air currents generated by the action of said cylinder during carding; and an air suction plenum extending substantially thereacross and circumferentially of said screen for relieving pressure generated by said air currents through a plurality of said spaced transverse slots.

2. The structure set forth in claim 1 including a lickerin screen extending beneath each of said lickerin rolls; a space defined between one of said lickerin screens adjacent said cylinder and said cylinder screen.

3. The structure set forth in claim 2 including a cover plenum exerting a negative air pressure over said lickerin rolls opposite said screens.

4. The structure set forth in claim 3 including a primary lickerin roll receiving fiber over a feed plate, a transfer lickerin roll and a final lickerin roll delivering fiber to said cylinder on one side thereof subsequent to doffing.

5. The structure set forth in claim 4 including a suction plenum extending beneath said lickerin screens having an opening adjacent an end adjacent said space, said suction plenum having an upper surface inclined from the rear forwardly toward said space facilitating reception of trash from said lickerin screens by said opening.

6. A carding machine comprising:

a plurality of lickerin rolls;

a cylinder receiving opened fibers from said lickerin rolls;

a doffer roll receiving carding fibers from said cylinder at a location remote from said lickerin rolls;

a card screen extending partially about said cylinder positioned adjacent thereto subsequent to reception of carded fibers therefrom by said doffer roll and prior to reception of fibers from said lickerin rolls;

said card screen having spaced sides and a bottom defining a plurality of circumferentially spaced transverse slots thereacross for relieving air currents generated by the action of said cylinder during carding; and an air suction plenum extending substantially thereacross and circumferentially of said screen for relieving pressure generated by said air currents through a plurality of said spaced transverse slots.

7. In a carding machine having at least one lickerin roll and a cylinder receiving opened fibers therefrom, the improvement including:

a card screen extending partially about said cylinder;

said card screen having spaced sides and a bottom defining a plurality of circumferentially spaced transverse slots thereacross for relieving air currents generated by the action of said cylinder during carding; and an air suction plenum extending substantially thereacross and circumferentially of said screen for relieving pressure generated by said air currents through a plurality of said spaced transverse slots.

8. The method of carding comprising the steps of:

subjecting a mass of fibers to the action of a plurality of lickerin rolls and a cylinder receiving opened fibers from said lickerin rolls preparatory to doffing;

removing trash and short fibers by exerting suction upon said cylinder subsequent to doffing by the action of a card screen extending partially about said cylinder and having spaced sides and a bottom defining a plurality of circumferentially spaced transverse slots thereacross for relieving air currents generated by the cylinder and having spaced sides and a bottom defining a plurality of circumferentially spaced transverse slots thereacross for relieving air currents generated by the action of said cylinder during carding; and creating a negative air pressure at said slots by an air suction plenum extending substantially thereacross and circumferentially of said screen for relieving pressure generated by said air currents through a plurality of said spaced transverse slots.

9. A carding machine comprising:

a plurality of lickerin rolls;

a cylinder receiving opened fibers from said lickerin rolls;

a doffer roll receiving carding fibers from said cylinder at a location remote from said lickerin rolls;

a card cylinder screen extending partially about said cylinder positioned adjacent thereto subsequent to reception of a carded fibers therefrom by said doffer roll and prior to reception of fibers from said lickerin rolls;

said card screen having spaced sides and a bottom defining a plurality of circumferentially spaced transverse slots thereacross for relieving air currents generated by the action of said cylinder during carding; and a space defined between one of said lickerin screens and said cylinder and said cylinder screen for expulsion of trash.

* * * * *